United States Patent [19]

Goebel

[11] Patent Number: 4,705,335

[45] Date of Patent: Nov. 10, 1987

[54] PLUG SAFE

[76] Inventor: Ronald G. Goebel, 1965 S. Sheridan, Denver, Colo. 80227

[21] Appl. No.: 824,447

[22] Filed: Jan. 31, 1986

[51] Int. Cl.[4] ..... H01R 13/44

[52] U.S. Cl. ..... 439/133; 174/67; 439/142

[58] Field of Search ..... 174/67; 339/36, 37, 339/82, 44 R

[56] References Cited

U.S. PATENT DOCUMENTS

| | | | |
|---|---|---|---|
| 3,293,588 | 12/1966 | Blonder | 174/67 |
| 4,063,110 | 12/1977 | Glick | 174/67 |
| 4,488,764 | 12/1884 | Pfenning et al. | 339/37 |

*Primary Examiner*—Gil Weidenfeld

*Assistant Examiner*—Paula A. Austin

*Attorney, Agent, or Firm*—Kyle W. Rost

[57] ABSTRACT

A plug safe provides a vessel that, in use, simultaneously contains a plurality of electrical plugs, wherein the vessel includes an open face for entrance and exit of the plugs. A closure selectively opens and closes the open face of the vessel. A plurality of apertures permit electrical cords attached to contained plugs to pass to the exterior of the vessel. A lock associated with the vessel and closure selectively secures the closure in position closing the open face of the vessel. The vessel includes a plug self-retaining means for, in use, resisting any spring forces tending to cause initially loaded plugs and cords to exit the apertures while subsequent plugs and cords are being loaded into further apertures.

2 Claims, 3 Drawing Figures

PLUG SAFE

BACKGROUND OF THE INVENTION

1. FIELD OF THE INVENTION

The invention generally relates to electrical connectors and more specifically to movable or removable nonuse covering means. The invention also generally relates to locks with specialty applications. A self-loading plug safe is disclosed.

2. DESCRIPTION OF THE PRIOR ART

One known technique for preventing unauthorized use of electrical equipment and machinery is to place a locking shield around the plug. The equipment thereby is placed out of-service and controlled by the key holder, regardless of whether the equipment would otherwise be operable. The benefits of such control are multi-faceted, such as improving safety by preventing children or untrained persons from using the equipment without supervision, preventing damage to the equipment or other property by misuse of the equipment, discouring theft of the equipment or its services, and controlling access and time of use.

Known patents relating to lock-boxes or safes for plugs include U.S. Pat. No. 4,488,764 to Pfenning. This patent discloses a locking box having a pair of apertures that each permit passage of an electrical cord. It is possible to isolate a plug within the box, lock the box onto a cord with the plug exposed, or even to lock an engaged plug and receptacle within the box.

U.S. Pat. No. 2,643,787 to Rockman discloses another lock-box for plugs. Similar art is shown in German Pat. Nos. 3,306,073 and 3,044,091.

Another type of plug lock is shown in U.S. Pat. No. 3,722,843 to Enckler. This device is a clamping rack that prevents removal of the cord plug from the rack, although the plug is exposed for use or non-use as desired. The electrical device is available for inspection and use when desired, but the captured cord deters theft.

Another teaching of similar relevance is U.S. Pat. No. 4,300,690 to Thomas, wherein a multiple groove display rack is equipped with a locking bail that closes the grooves. Although the main thrust of this disclosure is that coat hangers should be secured in the grooves, the grooves might serve as cord holders.

It would be desirable to create a plug safe or lock-box offering the benefits found in the prior art, but that would be easier to use and produce. In particular, for use in areas having several plugs to be protected, it would be an advantage to have a plug safe that can accommodate a plurality of those plugs, while, at the same time, being secured to a wall so that the safe remains in one place despite the tensions of the several cords. Additionally, the safe should compliment its multi-cord capability by being self-retaining of the cords as they are inserted.

To achieve the foregoing and other objects and in accordance with the purpose of the present invention, as embodied and broadly described herein, the plug safe of this invention may comprise the following.

SUMMARY OF THE INVENTION

Against the described background, it is therefore a general object of the invention to provide an improved plug safe adapted for use with a plurality of plugs or cords.

A more specific object is to provide a plug safe that is self-retaining of plugs or cords placed in designated receiving areas, so that stiff or cold cords do not pull free of the safe.

Another object is to provide a simplified safe structure in which security is maintained while allowing economy of manufacture. Accordingly, the plug safe employs integrated, multipurpose structural members.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a plug safe provides a plug-receiving compartment having an open face, a base wall, and a side wall angled acutely upwardly and inwardly into the compartment and toward the open face from the base wall. In addition, the side wall defines a plurality of cord-receiving slots, which slots have an entry/exit opening at an edge of the open face. A movable closure means is selectively positionable to cover the open face, and the closure means at least partially closes the entry/exit opening of the slots when covering the open face. A locking means is operable between the compartment and the closure means for selectively securing the closure means in a position covering the open face. The closure means defines a lip that partially overlaps the slots and the side wall.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

Figure 1:
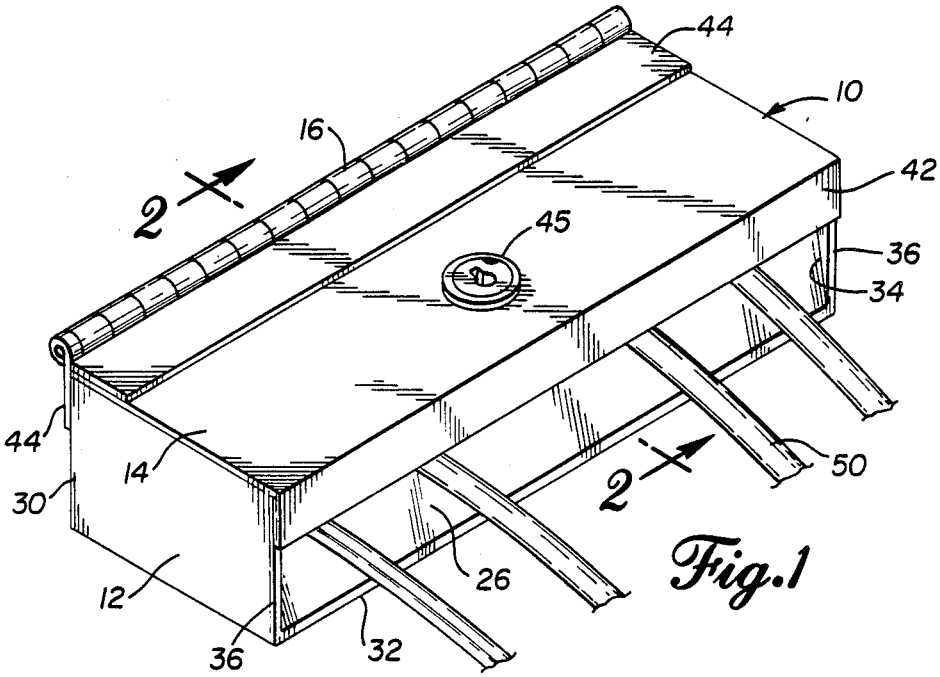
FIG. 1 is an isometric view of the plug safe, showing cords in operative positions.

As shown in the drawings, the plug safe 10 is formed from a container base 12 and a closure means or lid 14. The two are joined together, such as by a hinge 16, to form an enclosed volume adapted for receipt of electrical plugs, while providing a passageway for the electrical cord from each plug to extend out of the plug safe. A locking means such as a blade lock 18 is associated with the base and lid for securing the lid in closed position.

The container base 12 may be box-like in structure, having walls on all sides except one, which may be considered the top or face of the plug safe. Specifically, the container base may include a bottom wall 20, an opposed pair of end walls 22, and a back side wall 23. In addition, a front side wall 26 is generally opposed to the back side wall. The end walls may be mutually parallel, rectangular, and normal to the bottom wall 20 and end walls 22. The bottom wall 20, which also may be rectangular in shape, may be attached to the end walls 22 at its opposite parallel edges 24 and also may be attached to the back side wall along an adjacent edge 28 normal to edges 24. The back side wall 23 may be attached to the end walls 22 along an edge 30 adjacent to edges 24. Consequently, when the container base is resting with bottom wall 20 on a horizontal surface, the end walls 22 and back side wall 23 are vertically disposed and surround three sides of the bottom wall.

The front side wall 26 may be attached to the bottom wall 20 along a common edge 32 opposite from edge 28. The end edges of the front wall are connected to the end walls at junction lines 34, which are inclined inwardly from edge 32. Consequently, the front edges 36 of the rectangular end walls 22 relatively diverge from the junction lines 34 with increasing distance from edge 32. A top edge 38 of the front wall, best shown in FIG. 2, is at the same height as the top edges of the end walls 22 and back wall 23, which together define the perimeter of the open face of the container base 12.

Figure 2:
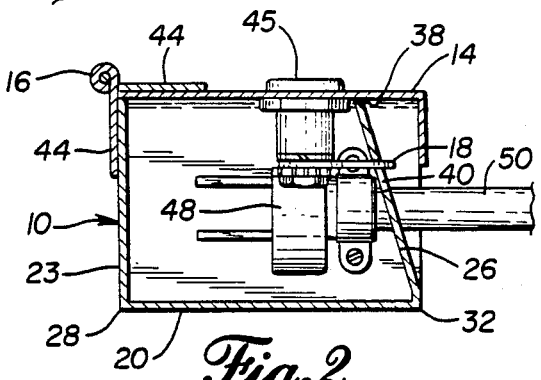
FIG. 2 is a cross-sectional view taken along the plane of line 2—2 of FIG. 1 and showing internal sutructure of the plug safe together with a plug in operative position.
Figure 3:
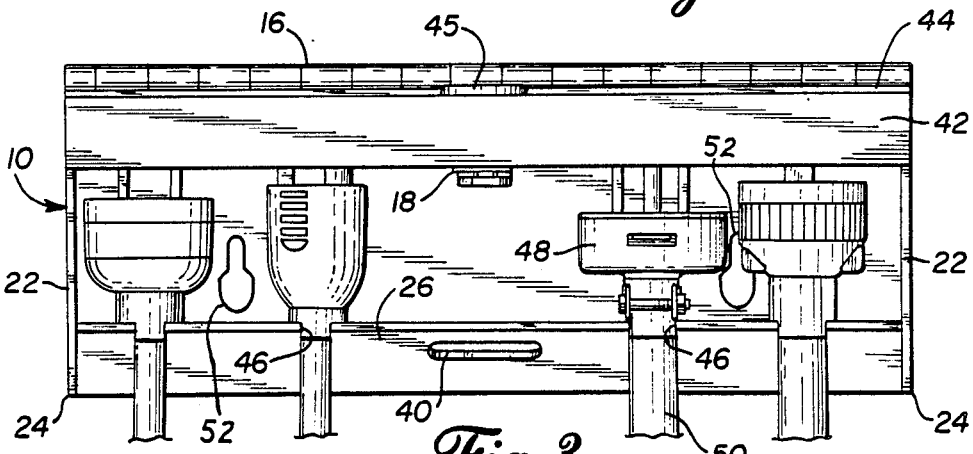
FIG. 3 is a top view of the plug safe, showing the lid in open, upright position.

A selective locking means may include blade slot 40, shown in FIGS. 2 and 3, and is associated with the front wall 26, preferably at a position spaced from the bottom wall 20. The preferred blade slot is near the top edge 38 of the front wall and is centrally disposed between the end walls 22.

Lid 14 is selectively positionable in open and closed positions. When in closed position as shown in FIGS. 1 and 2, the top plate of the lid covers the open face of the plug safe. In addition, as best shown in FIG. 2, the front of the top plate 14, opposite from hinge 16, extends laterally beyond the top edge 38 of the front wall to at least the laterally offset position of the front edges 36 of the end walls 22. A lip 42 depends from the offset edge of the lid and partially overlaps the front wall 26, although this lip is juxtaposed to the front edges 36 of the end walls 22, thereby being spaced from the front wall by a similar distance as the edges 36. The gap between the lip 42 and the front wall 26 is substantial, and may be on the order of one-half inch (1.27 cm) at the closest approach of the lip and front wall. The overlap of lip 42 and front wall 26 may be sufficient to cause the lip extend to approximately the height of blade slot 40, serving as a determent to tampering with the lock. In addition, the lip 42 is a strengthening rib for the top plate of the lid and aids in preventing the lid from being bent or pryed.

At the opposite edge of the lid, the hinge 16 is attached. A hinge flange 44 may be attached to each of lid 14 and back wall 23, such as by welding. A full length piano hinge is preferred, which further reinforces the strength of the lid's top plate and thereby discourages tampering. Between the hinge and the lip, the top plate of the lid may carry an additional portion of the locking means, such as a key lock 45 having a blade that pivots into locked position to engage the blade slot 40. Because the lid is highly stable in construction and attachment to the remaining portion of the plug safe, the lock is difficult to move or release by any deformation of the lid. The box-like nature of the container base 12 causes this structure also to be stable, which assures that the locked plug safe will resist many common type of physical assault.

A plurality of cord slots 46 are formed in the front wall 26, such as two slots on each side of the blade slot 40. The cord slots are preferred to extend downwardly from an entry/exit opening at edge 38 to a position below the lower edge of lip 42. As generally shown in the drawing figures, the slots 46 are smaller in width than the plugs 48 but are of a suitable size to accept the cords 50. Thus, the plugs 48 serve as captive elements on the cords when the lid 14 is closed, sealing the slot entry/exit at edge 38.

As noted, front wall 26 is inclined toward back wall 23. Thus, the slot entry/exit opening at edge 38 is closer to wall 23 than is the slot base. In a typical application, the plug safe may have a height at edge 36 of two inches (5 cm), and edge 38 may be set inwardly from edge 38 by 0.75 inch (1.9 cm). Bottom wall 20 will be mounted to an underlying surface, either vertical or horizontal, such as by securing the plug safe on mounting screws through keyhole slots 52 in the bottom wall. On a horizontal surface, such mounting results in wall 26 having a slope of 2.67 with respect to the bottom wall 20. On a vertical surface, the keyhole shape of slots 52 direct that the plug safe be mounted with wall 26 at the bottom of the box, resulting in a slope of 0.375 with respect to edge 38 as a base. This angular disposition of wall 26 with respect to the mounting surface causes the slots to be self-retaining of the plugs that might be placed in the safe. This feature is of particular advantage in the context of a multi-cord application, especially when the cords are stiff, as when they are cold or of large diameter.

When lid 14 is closed, the lip 42 protects not only the blade slot 40 and its engaged lock, but also protects the top plate of the lid and the opening of cord slots 46 in edge 38 from prying. In addition, the lip 42 is a hold-down for the cords 50, which maintains the cords near the bottom of the cord slots. When the cords are locked in the plug safe, this positioning assists in maintaining the plugs against the bottom end of the slots, where the plugs are most strongly secured by the safe. When the safe is opened, this prior positioning of the cords and plugs by the lip 42 compliments the self-retaining angle of the front wall 26 by aiding in keeping the cords from springing out of the safe. When the safe is being closed, the lip acts as a pre-positioning means to hold or push some of the cords in place while there remains finger room beteen the lid 14 and base 12 for dealing with other stiff or springy cords.

In use, the safe can be mounted in any desired position. Cords of electrical equipment to be secured against use can be locked in the safe by inserting the plugs into the safe base 12 with the corresponding cords 50 disposed through an appropriate slot 46. By virtue of the angled front wall 26, the plugs are self-retained against removal from the slots, and lip 42 further aids in insertion of subsequent plugs. When the lid 14 is closed and locked, the cords are not only secured, but the lip 42 shields the contact between the lid 14 and edge 38 from prying or other tampering.

While the primary use of the plug safe is intended to be for securing unplugged equipment, it is also possible to secure equipment still in use or a plugged connection. The latter capabilities are made possible by the presence of the multiple slots 46. If a middle section of an electrical cord is weaved in one slot and out another, the cord may be locked in the safe while the equipment is in operation. This function is useful when the plug safe is firmly fastened to a large or heavy object, as it discourages theft of the equipment. If a plugged connection is locked in the plug safe and the cord on the opposite sides of the connection are respectively weaved into and out of appropriate slots 46 of the plug safe, the connection itself is secured against disconnection, in addition to providing the security assistance noted above.

Finally, the construction of the plug safe may be seen to offer ease and economy of manufacture, as the design is basically that of a box having an inclined front wall and associated, spaced apart, overlapping from the lid. The lock itself may be of economical design. The inclined wall and overlapping lip offer advantages of ease of use and good security against tampering, while reflecting that any plug safe is limited in effectiveness if a thief is willing and able to sever the electrical cord. Consequently, the plug safe employs low-cost but effective structural security and operational assistance measures, in keeping with the inherent limitations of this type of device. Expensive, complex features are avoided so as to not produce false or unreasonable expectations of security.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. An improved plug safe of the type having a box-like body defining a plug-receiving compartment having an open face surrounded by perimetric side walls, closed opposite the open face by a base wall, and having a lid that is selectively closeable over said open face and is hingedly connected to said plug-receiving compartment at a first edge of the lid; a front side wall defining therein a plurality of cord-receiving slots, each slot having an entry/exit opening at an edge of the open face, the lid at least partially closing the entry/exit opening of the slots when covering the open face, and having a locking means operable between said compartment and lid for selectively securing the lid in position covering the open face; the improvement comprising:

a mounting means associated with said base wall for fastening the plug safe to an underlying surface with the base wall against the underlying surface;

wherein said front side wall is angled acutely inwardly into said compartment from the base wall toward the open face and, in use, angularly urges cords received in said slots to move toward the slot base when the base wall is mounted horizontally or vertically such that the front side wall is carried in a side or bottom orientation;

said lid is hingedly attached to a back side wall opposite from said front side wall such that the lid is closeable forwardly over the front wall;

a substantially perpendicular depending lip at a second, opposite edge of the lid;

a blade lock carried on the lid and having a blade that is pivotable toward the lip for locking the lid to said front wall of the plug-receiving compartment; and wherein the front wall defines a slot for receiving the blade, said slot being spaced by the angular disposition of the front wall inwardly from the lip by a substantial gap defining a blade receiving area.

2. An improved plug safe of the type having a plug receiving compartment by a rectangular base wall; a pair of opposite, rectangular end walls connected to the respective opposite ends of the base wall and substantially perpendicular thereto; a back wall connected to the base wall and opposite end walls and substantially perpendicular to both; and a front wall connected to the base wall and end walls; the end walls, back wall, and front wall together defining a perimeter edge of an open face of said compartment opposite from the base wall; the front wall defining a plurality of cord-receiving slots extending toward the base wall from its edge at the open face; and a lid selectively movable between open and closed positions, wherein in closed position the lid covers the open face, the lid including a top plate having a hinge connecting said top plate and the back wall along a first edge of the top plate; the improvement comprising:

said front wall being carried at an acute upward and inward angle with respect to the base wall and angularly retaining plugs received in the compartment with their cords in the cord receiving slots;

a blade lock carried by said top plate and having a blade moveable between both locked and unlocked positions;

a blade receiving slot defined in said front side wall for receiving said blade when the lid is in closed position and the blade is in locked position; and wherein said lid further comprises a lip depending substantially normally to both said top plate and said bottom wall and overlapping the blade receiving slot when said lid is in closed position, wherein the portion of the front wall defining the blade receiving slot is spaced inwardly from the lip by a substantial gap due to the angular relationship between the front wall and lip, the gap a blade reception area outside the front wall.

* * * * *